United States Patent [19]

Dashew et al.

[11] 4,056,073

[45] Nov. 1, 1977

[54] BOAT THRUSTER

[75] Inventors: Stanley A. Dashew, Santa Monica; Charles D. Sutton, Woodland Hills, both of Calif.

[73] Assignee: Omnithruster Inc., Compton, Calif.

[21] Appl. No.: 664,871

[22] Filed: Mar. 8, 1976

Related U.S. Application Data

[63] Continuation-in-part of Ser. No. 491,797, July 25, 1974 abandoned.

[51] Int. Cl.[2] ..... B63H 25/46

[52] U.S. Cl. ..... 114/151; 115/12 R

[58] Field of Search ..... 114/148, 151; 115/11, 115/12 R, 14, 15, 16; 60/221, 222; 137/625.21, 625.22, 625.23, 625.41, 625.47

[56] References Cited

U.S. PATENT DOCUMENTS

| | | | |
|---|---|---|---|
| 1,548,936 | 8/1925 | Dumont | 60/222 |
| 1,758,847 | 5/1930 | McIntosh | 115/14 |
| 2,024,274 | 12/1935 | Campini | 115/16 |
| 2,330,674 | 9/1943 | Briggs | 114/151 |
| 2,696,077 | 12/1954 | Goodman | 115/13 |
| 2,868,176 | 1/1959 | Bennett | 137/625.22 |
| 3,078,661 | 2/1963 | Spence | 114/151 |
| 3,128,740 | 4/1964 | Burgin | 115/12 R |
| 3,137,266 | 6/1964 | Perrier et al. | 115/12 R |
| 3,237,585 | 3/1966 | Winter | 114/151 |

FOREIGN PATENT DOCUMENTS

| | | | |
|---|---|---|---|
| 684,176 | 12/1952 | United Kingdom | 115/16 |

*Primary Examiner*—Trygve M. Blix
*Assistant Examiner*—Jesus D. Sotelo
*Attorney, Agent, or Firm*—Lindenberg, Freilich, Wasserman, Rosen & Fernandez

[57] ABSTRACT

An improved bow thruster including a diverter valve with an inlet connected to a water pump, a pair of outlets extending to either side of the boat, a valve mechanism for accurately controlling the amount of thrust obtained from both outlets, and a deflector positioned at each outlet. Each deflector is movable between a first position wherein it allows sideward water discharge to thrust the bow to the side, and a second position wherein it directs water rearwardly to move the boat in a forward direction, or if required, to a third position to move the boat rearwardly.

5 Claims, 10 Drawing Figures

Fig. 1
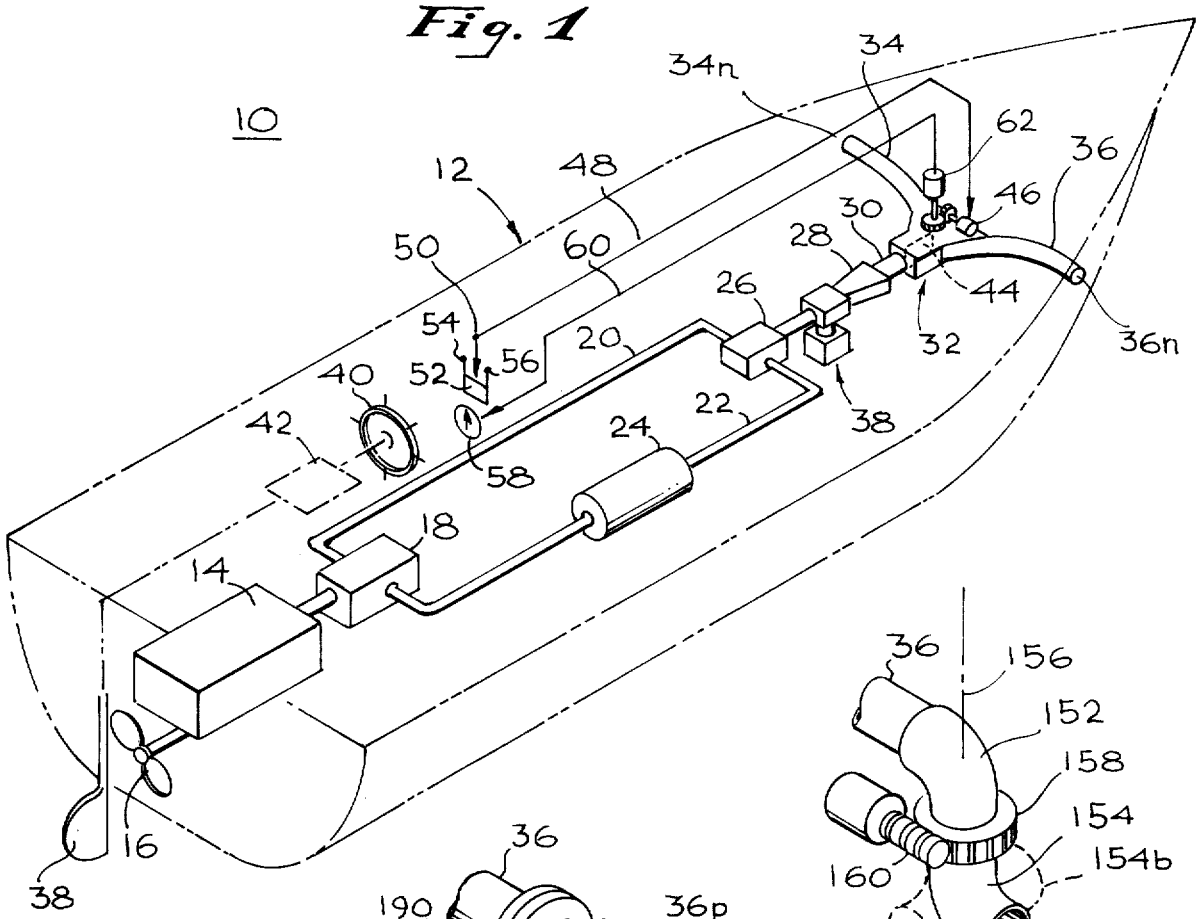
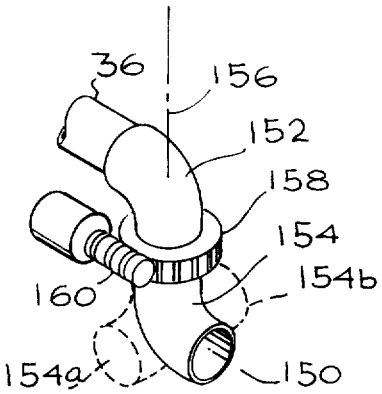
Fig. 2
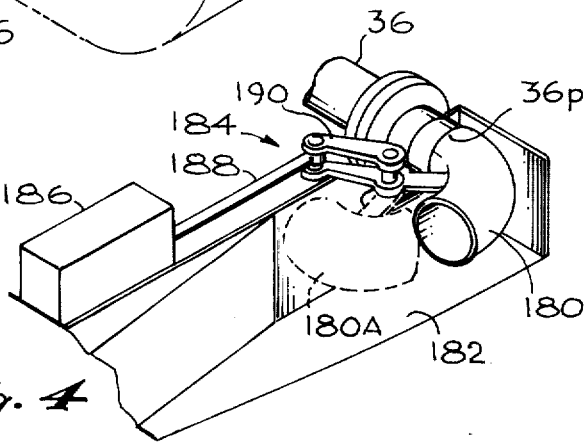
Fig. 4
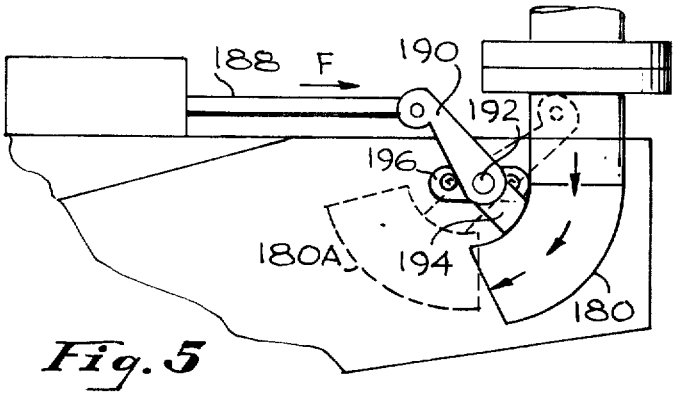
Fig. 5
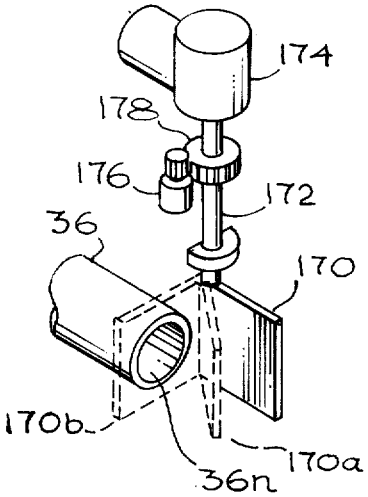
Fig. 3

BOAT THRUSTER

CROSS-REFERENCE

This is a continuation-in-part of U.S. patent application Ser. No. 491,797, filed July 25, 1974, now abandoned.

BACKGROUND OF THE INVENTION

A boat can be more easily maneuvered by the use of a bow thruster which consists of a water pump and a valve arrangement for diverting the water into either of two pipelines that open at the opposite sides of the boat near the bow. It would be desirable if the thrust obtainable from a water pump placed on board a vessel could be used to help maneuver the boat, or if required, to propel the boat forwardly, as when the propeller has been broken or where the propeller could cause injury to persons or articles in the water.

SUMMARY OF THE INVENTION

In accordance with one embodiment of the present invention, a thruster arrangement is provided which permits conversion from sideward bow thrusting to forward or rearward thrusting, in a simple and efficient manner. The apparatus includes an inlet connected to a high capacity water pump, a pair of outlets extending to either side of the boat at the bow, valve means for controlling the amount of water, allowed to pass through the pair of outlets and a deflector at each outlet. The deflector can be moved between positions wherein it allows sideward water discharge to thrust the bow to the side, wherein it directs water rearwardly to move the boat in a forward direction or wherein it directs water forward to move the boat to the rear.

The valve means, which accurately controls the amount of water allowed to pass through the pair of outlets thereby provides proportional thrusting to both sides of the vessel which enables accurate position holding, steering and warping of a vessel.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 1 is a perspective view of a bow thruster system of the invention mounted on a boat;

FIG. 2 is a partial perspective view of the apparatus of FIG. 1;

FIG. 3 is a partial perspective view of a thruster deflector apparatus constructed in accordance with another embodiment of the invention;

FIG. 4 is a perspective view of a thruster deflector apparatus constructed in accordance with another embodiment of the invention;

FIG. 5 is a plan view of the apparatus of FIG. 4;

DESCRIPTION OF THE PREFERRED EMBODIMENTS

Figure 6:
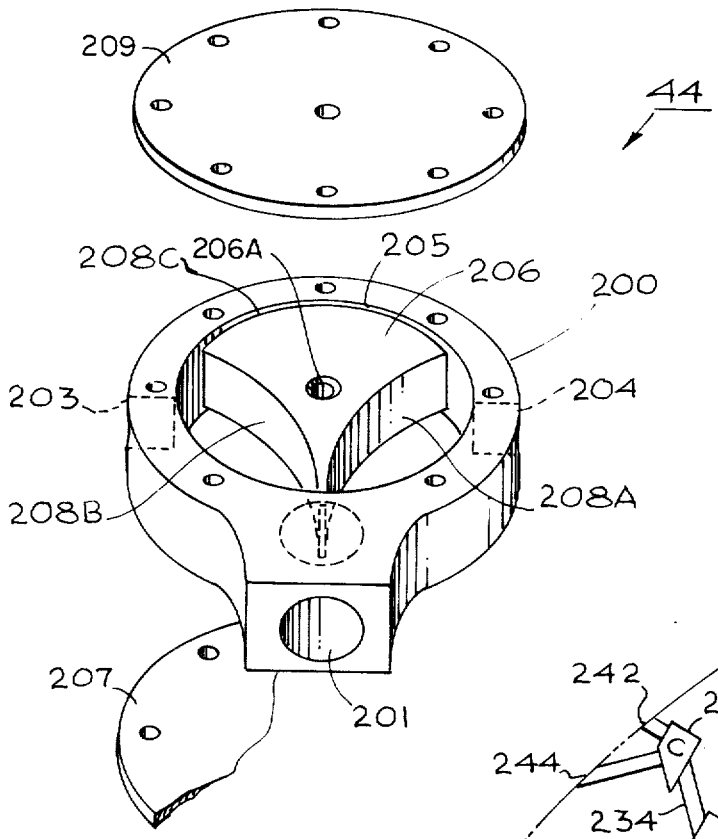
FIG. 6 is a perspective view of a vane device valve means suitable for use with the invention.

FIG. 1 illustrates a bow thruster system 10 in the hull of a boat 12 for facilitating maneuvering of the boat. The system includes an engine 14 located in the rear half or stern portion of the boat and is utilized primarily to drive the main boat propulsion which may be a propeller 16 or a water jet thruster. The engine is connected to a hydraulic pump 18 which pumps hydraulic fluid through a pair of hydraulic lines 20, 22 that include a cooler 24 and that carry the hydraulic fluid through a hydraulic motor 26 located in the bow portion of the hull. The hydraulic motor 26 drives a high capacity water pump 28 whose output 30 is connected to a diverter valve 32. The divereter valve means is connected to port and starboard lines 34, 36 that lead to opposite sides of the boat at the bow portion thereof. Water enters the system through an inlet assembly 38, is pumped by the pump 28 to the diverter valve 32, and emerges as a jet stream from either or both of a pair of thruster nozzles **34*n*, 36*n*, at the ends of the lines 34, 36. The emerging water can be utilized to push the bow to either side, to thereby turn the boat or make other manuevers. This manner of steering is provided in addition to conventional steering by a rudder 38 which can be pivoted by a steering control or wheel 40 located at the wheel house or control station 42** on the boat. Although the main propulsion engine of the boat may be utilized for powering the bow thrusters, it should be noted that auxiliary engines used to generate electricity often may be used instead.

The diverter valve 32 of the bow thruster controls the flow of water between the port and starboard lines 34, 36 by the use of a valve means such as a vane device 44. The vane device is pivoted by a suitable motor 46 which can be energized to rotate in either of two directions. The motor is energized by current received over conductors 48 that extend through a switch 50 to a power source 52. The switch 50 can be left in a neutral position to de-energize the motor or can be moved to either of two contacts 54, 56 to energize the motor 46 in opposite directions to pivot the vane device 44. The pivotable position of the vane device 44 is constantly indicated by a position indicator or meter 58. The meter 58 is connected through a line 60 to a potentiometer 62 that is connected to the shaft of the pivotable vane device 44. Both the control switch 50 and indicator 58 are located at the control station 42 in the rear portion of the boat, so that they are accessible to a person stationed there who is operating the wheel 40 and engine controls (not shown). The operator at the control station can move the rudder 38 and vane 44 to extreme positions at both the bow and stern, so that the water jet stream can move the boat sideways without turning, or cause it to execute a very sharp turn.

The versatility of the bow thruster system can be increased by providing means for deflecting water emerging from the thruster outlets in a variety of directions instead of just sidwardly. FIG. 2 illustrates a thruster nozzle assembly 150 which includes a first elbow 152 for diverting water from the starboard line 36 into a downward direction and a movable second elbow 154 which diverts the water into a horizontal direction. The second elbow 154 is pivotably mounted about a vertical axis 156 on the first elbow so that the second elbow can be pivoted from the position shown in solid lines wherein it discharges water laterally to thrust the bow to one side, to a second position indicated at 154*a* wherein it discharges water rearwardly to propel the boat forwardly, and to a third position indicated at 154*b* wherein it discharges water forwardly to move the boat to the rear. In order to permit controlled movement of the second elbow-nozzle device 154, a worm wheel 158 is fixed to the nozzle 154 and a worm 160 is engaged with the worm wheel and is driven by a motor to turn the nozzle.

FIG. 3 illustrates another arrangement for deflecting the water emitted from the starboard line 36, which includes a pivotably mounted thruster vane positioned at the starboard line end or nozzle 36*n*. The thruster vane 170 can pivot from the position shown in solid lines in FIG. 3 wherein it allows water to move sidewardly to produce a sideward thrust on the boat, or can be pivoted to a position 170*a* wherein it deflects the issuing water to a rearward direction to provide forward thrust to the boat. The vane 170 is mounted on the shaft 172 which can be turned by a gear motor 174. A potentiometer 176 coupled by gears 178 to the vane shaft indicates the position of the vane 170 at a remote meter which may be located at the control station of the boat. The thruster vane 170 also can be pivoted to a position 170*b* wherein it sealingly covers the water line 36, to thereby provide a shutoff valve that prevents the inflow of water when repair work is to be done on the thruster system.

FIGS. 4 and 5 illustrate another arrangement for deflecting the water emitted from one of the lines such as starboard line 36. The apparatus includes a deflector means in the form of a deflector nozzle 180 which directs water emanating from the outlet 36*p* into a largely rearward direction, to propel the boat. The nozzle can be moved to the position 180A, wherein it is out of line with the outlet 36*p*, to permit sideward thrusting of the bow of the boat. The nozzle lies in a recess 182 formed in the side of the bow, so that the nozzle is protected. The recess has a deep forward portion at the outlet 36*p*, and is rearwardly tapered in depth. A driving mechanism 184 is provided to move the nozzle between the positions 180 and 180A.

The nozzle is in the form of a pipe with more than a 45° bend, the nozzle 180 having a bend of approximately 75°. This nozzle, when in the position 180, efficiently changes the directions of the pumped water, so that there is very little loss of power in passage through the nozzle. When the nozzle is in the position 180A wherein it is out of line with the outlet 36*p*, water is emitted directly from the outlet 36*p* without any power loss from the nozzle. The possibility of binding of the nozzle is minimized because there is no rotational joint about which the nozzle turns about its axis, as in the case of the elbow 154 of FIG. 2. There are pivot joints in the mechanism 184 that move the nozzle, but these are simpler and of smaller diameter, and therefore less likely to bind.

The mechanism 184 that pivots the nozzle, includes an electrically energized gear motor 186 which drives a rod 188 forward and backward. The forward end of the rod is pivotably connected to one end of arms 190 whose other ends are fixed to shaft 192 that are, in turn, connected by arms 194 to nozzle 180. The shaft 192 is pivotably mounted on a bracket 196 that is fixed to the boat. When the motor 186 moves the rod forward, in the direction of arrow F, the nozzle is pivoted to position 180A, and when the rod is moved back the nozzle is moved to position 180.

FIG. 6 is a perspective view of a suitable vane device 44 for controlling water flow from the pump through the port and starboard lines. The vane device comprises a housing 200, having an inlet passage 201 which connects to the pump outlet 30, and two outlet passages, respectively 203, 204, respectively connected to the respective lines 34, 36. The housing contains a central circular cavity 205 wherein there is pivotably supported a substantially wedge shaped vane 206. Top and bottom plates respectively 209 and 207 are shown for sealing the central cavity 205.

It should be noted that the vane 206 is rotatable about its center 206A, which is a beveled opening into which is inserted a shaft, not shown, for the purpose of positioning the vane. The vane has two inwardly curved surfaces, 208A, B, which flare out to an outwardly curved back surface, 208C.

Placing the vane positioning axis at its center, instead of at one end as has been done heretofore, and curving the vane surfaces, instead of using flat surfaces has the effect of reducing considerably the power that is required to be applied to move the vane to a desired position against the forces being applied by the water stream. If one analogizes a vane and its positioner as a lever and fulcrum, with previously known vanes, the fulcrum is at one end and the force "*f*" against which it must act may be considered a distance "*x*" away toward the other end. By moving the fulcrum to the center of the vane and curving the vane surfaces, the forces against which the vane must act are applied to its surfaces on both sides of the fulcrum in varying degrees as the vane is rotated. Thereby the distance of application of the force against which the vane must move is notably reduced but a force is also applied to the vane on the other side of the fulcrum which aids in overcoming the force against which the vane must move. Because of the resulting reduction in power required of the vane positioning motor, there is also a resulting reduction in the size and cost of the motor required to move the vane.

Figure 7:
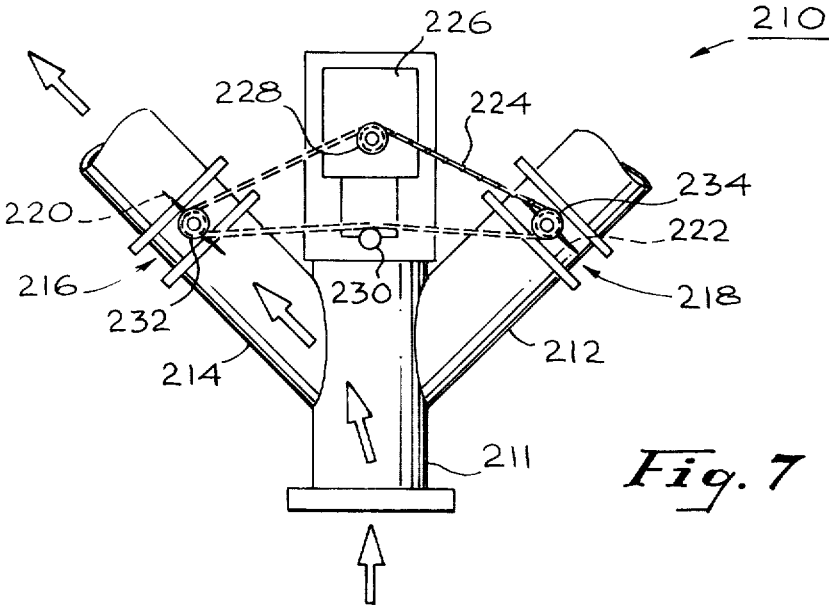
FIGS. 7 and 8 are schematic plan views showing two positions of a preferred diverter valve means.
Figure 8:
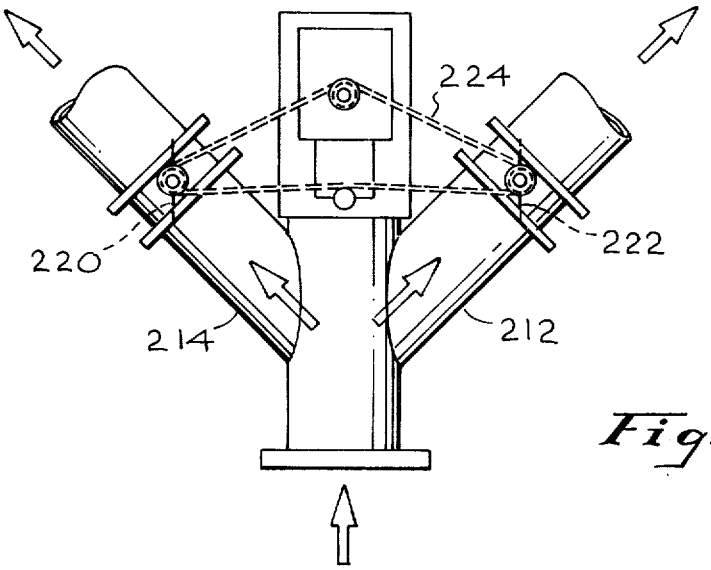
Figure 9:
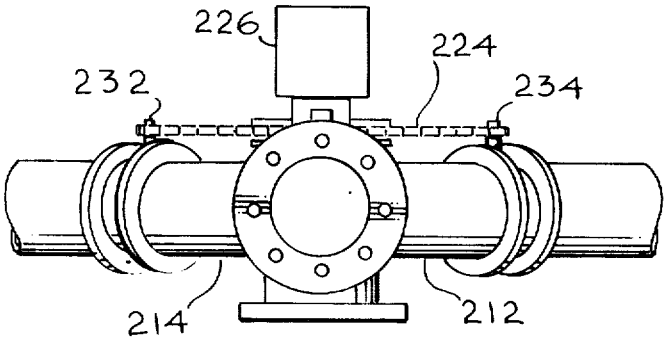
FIG. 9 is a view, in elevation, of the preferred diverter valve means looking into the flow inlet.

FIGS. 7, 8 and 9 are respectively two plan views and a view in elevation of a preferred arrangement for a valve means or a diverter valve 210, in accordance with this invention. It includes an inlet pipe 211 which connects to the pump output 30. The respective outlet pipes 212, 214 respectively connect to outlet lines 34, 36. Within each outlet pipe there is a butterfly valve respectively 216, 218, each of which has a pivotably supported vane respectively 220, 222. Both vanes are simultanously moved by means of a drive chain 224.

A motor 226, which may be controlled, in the manner described for the motor 46 in FIG. 1, drives a drive sprocket gear 228. The chain 224 is engaged by the drive sprocket gear and three other sprocket gears which include an idler gear and two gears respectively 232, 234 which actuate the respective vanes 220, 222.

FIG. 7 shows the vanes positioned so that the starboard line is open and water will flow therethrough, and the port line is closed. FIG. 8 shows the vanes positioned in their half open positions. The vanes can assume all positions from the one with the starboard line closed and the port line open to the one with the starboard line open and the port line closed.

The advantages of the diverter valve system shown in FIGS. 7, 8 and 9 over all previous systems is that it enables a precision control of the thruster system not attainable heretofore. It enables proportional control of the two water streams and thereby proportional thrusting. Most boat thruster system are designed to turn the water streams on or off because they are meant to push a boat left or right. The system described hereinabove is actually a bow steering system for which proportional thrusting is required. The on-off boat thruster systems provide an action such as is obtained by swinging a rudder from full left to full right which causes very erratic oversteering.

If the boat thruster system is to be controlled by an automatic pilot, it is important that the system be capable of rapid minute changes, such as are obtainable with the system described, otherwise the vessel would steer an erratic course. The same is true if the boat thruster system is to be used for boat position keeping where wind and wave are such that a large thrust on one side of the boat and a lesser thrust on the other are required to maintain a desired boat heading and position.

The combination of the proportional thrusting arrangement and either the nozzle assembly or thruster vane assembly described herein enable accurate position keeping; again, wind and tide can be such as to require minute heading adjustments, obtainable only by a combination of aft thrusting on one side of the boat and side thrusting on the other.

In prior art boat thruster systems where some kind of proportional or side to side thrusting was desired, the skipper of the boat would position his vane deflector and change the pump speed. This adds another burden to a skipper, already burdened with controlling engine speed. Further, a controllable variable speed pump is more expensive than a single speed pump which is all that is required with the proportional boat thrust system provided by this invention.

Figure 10:
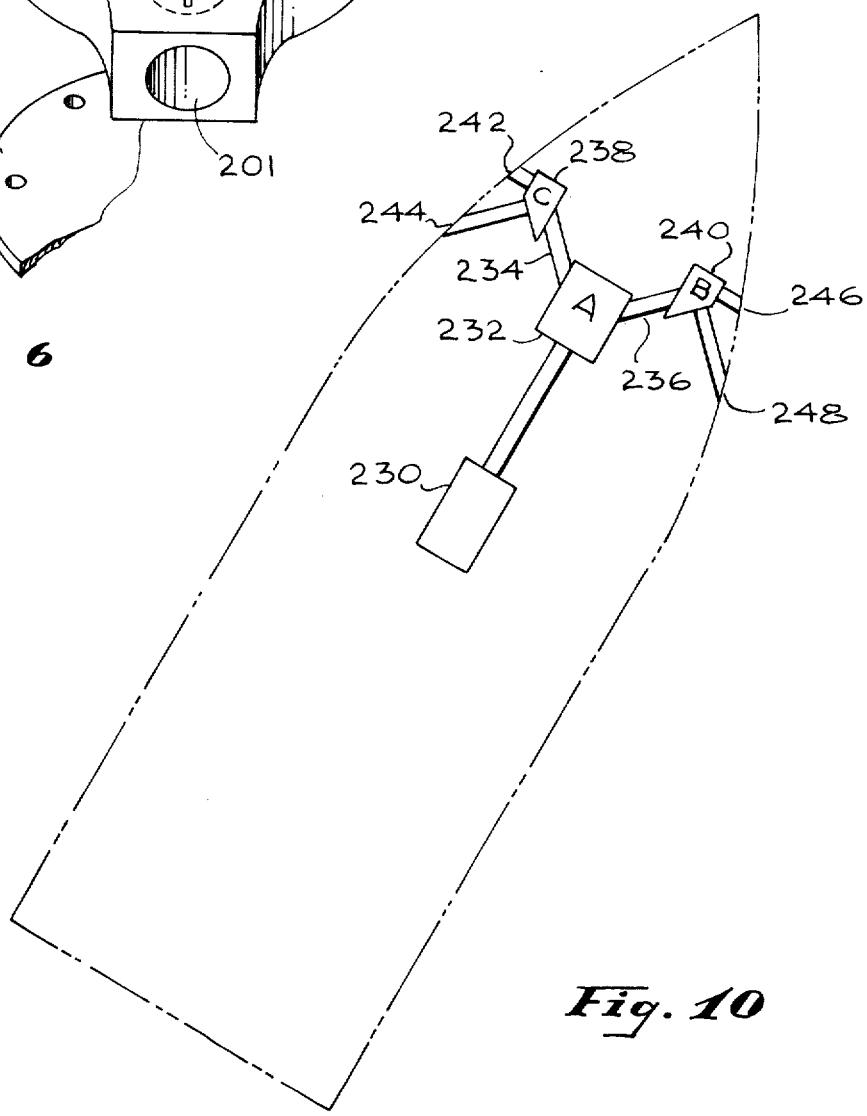
FIG. 10 is a schematic drawing of another embodiment of the invention.

FIG. 10 is a schematic view of still another embodiment of the invention. In the boat hull there is positioned a pump 230 whose output is connected through a passageway to first manifold, which contains a diverter valve, such as is shown in FIG. 6 or FIG. 7. The first manifold 232 is connected through two pipes respectively 234, 236, to second and third manifolds, respectively 238, 240. Each of the manifolds include diverter valves, such as shown in FIG. 6 or FIG. 7. The outlet pipes respectively 242, 244 extend from manifold 238 to and through the hull of the boat. Two outlet pipes respectively 246, 248 extend from manifold 240 to and through the hull of the boat.

The outlet pipes 242 and 246 extend sidewards through the hull and water flowing through either produces a sidewards thrust; or through both can be used, under certain circumstances, for position keeping. The outlet pipes 244, 248 extend rearwardly and water flowing through either produces turning; or through both produces forward propulsion. For rearward propulsion, either a vane device can be positioned behind each pair of outlet pipe openings so that the water coming out of an outlet pipe can be diverted forwardly and thereby propel the boat backward.

The vane device in manifold 232 is used to control the amount of water flowing to either set of outlet pipes and therefore the amount of thrust resulting. It can therefore be used to determine steering. The vane devices in manifolds 238 and 240 are used to determine which of the respective outlet pipes are open and which are closed. They thereby determine whether the boat will move forward or sidewards.

Accordingly, the present invention provides a novel and useful boat thrust system which enables accurate steering, boat position keeping as well as the use of an automatic pilot, while reducing the cost of the pump and vane control systems.

Although particular embodiments of the invention have been described and illustrated herein, it is recognized that modifications and equivalents may readily occur to those skilled in the art and consequently, it is intended that the claims be interpreted to cover such modifications and equivalents.

The embodiments of the invention in which an exclusive property or privilege is claimed are defined as follows:

1. In a boat having a hull with bow and stern portions the improvement comprising pump means mounted in said hull for pumping water, thruster means coupled to said pump means for receiving the water pumped thereby, said thruster means including a common passageway connected to said pump means at one end and a pair of thruster outlet means extending to either side of said hull from said common passageway to an opening to the sea for discharging water thereinto, valve means in said thruster means for controlling the amount of water passing from said common passageway to each of said thruster outlet means, said valve means comprising a first and a second butterfly valve respectively positioned in each of said thruster outlet means, and means for simultaneously controlling said butterfly valves from and between a first position wherein said first butterfly valve completely closes off one of said two branching passageways and the other is entirely open, to a second position wherein said second butterfly valve completely closes off the other of said two branching passageways and said one branching passageway is entirely open, and means positioned at the opening to the sea of each said thruster outlet means for determining the direction of water flow after said water is discharged from each said thruster outlet means to the sea, said means comprising a vane pivotably supported adjacent to and outside of each outlet opening, and means for selectively pivoting each of said vanes between and including a position at which each said vane fully covers an opening to the sea of a thruster outlet means to a position at which each vane fully uncovers an opening to the sea.

2. In combination with a boat having a hull with bow and stern portions, the improvement comprising:

pump means mounted in said hull for pumping water; and thruster means having a common passage coupled to said pump means, for receiving the water pumped thereby, said common passage connecting to two thruster outlet means opening to the sea at either side of the bow of the hull for discharging water into the sea thereat;

said boat hull having a recess on either side of said bow, said recess having a deep forward portion and being tapered in depth to have a progressively smaller recess depth at progressively more rearward locations;

said outlet means includes a sidewardly opening outlet at said forward portion of said recess, and said diverter means including a movable member lying in said recess, and each of said thruster outlet means including diverter means selectively operable to assume different desired positions to direct water being discharged in different directions for position holding steering or propelling said boat.

3. The improvement described in claim 2 wherein:

each of said outlet means includes an outlet opening sidewardly of said boat hull, said diverter means includes a vane pivotably supported adjacent to and outside of each outlet opening, and means for selectively pivoting each of said vanes between and including a position at which each vane fully covers an outlet opening and a position at which each vane fully uncovers an outlet opening.

4. In combination with a boat as recited in claim 2 wherein:

each of said two thruster outlet means contains a manifold means having a first outlet pipe for providing a water discharge sidewards of said boat and a second outlet pipe for providing a water discharge rearwards of said boat, and a valve means in each of said manifold means for determining which of said first or second outlet pipes can discharge water.

5. In combination with a boat having a hull with bow and stern portions, the improvement comprising:

pump means mounted in said hull for pumping water; and thruster means having a common passage coupled to said pump means, for receiving the water pumped thereby, said common passage connecting to two thruster outlet means opening to the sea at either side of the bow of the hull for discharging water into the sea thereat;

each of said thruster outlet means including diverter means selectively operable to assume different desired positions to direct water being discharged in different directions for position holding steering or propelling said boat, said hull having a recess at either side of the bow thereof, each of said outlet means includes an outlet lying in a corresponding recess and oriented to direct water in a primarily sideward direction from said recess; and said diverter means includes nozzle having opposite ends and being curved by at least about 45°, and means for selectively moving said nozzle with an end thereof against said outlet to direct water exiting from said outlet into a primarily rearward direction, and for moving said nozzle away from said outlet to allow water to exit into the sea in a primarily sideward direction.

* * * * *